US010611153B2

(12) United States Patent
Dai

(10) Patent No.: US 10,611,153 B2
(45) Date of Patent: Apr. 7, 2020

(54) PRINTING HEAD AND INKJET PRINTING DEVICE

(71) Applicant: BOE TECHNOLOGY GROUP CO., LTD., Beijing (CN)

(72) Inventor: Qing Dai, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/121,849

(22) Filed: Sep. 5, 2018

(65) Prior Publication Data

US 2019/0202205 A1 Jul. 4, 2019

(30) Foreign Application Priority Data

Jan. 3, 2018 (CN) ..... 2018 1 0004149

(51) Int. Cl.
*B41J 2/14* (2006.01)

(52) U.S. Cl.
CPC ..... *B41J 2/1433* (2013.01); *B41J 2/14233* (2013.01); *B41J 2002/14419* (2013.01); *B41J 2202/11* (2013.01); *B41J 2202/12* (2013.01)

(58) Field of Classification Search
CPC .. B41J 2/14032; B41J 2/1404; B41J 2/14145; B41J 2/1433; B41J 2/14201; B41J 2/14209
See application file for complete search history.

(56) References Cited

U.S. PATENT DOCUMENTS 4,611,219 A * 9/1986 Sugitani et al. ..... 347/47
6,223,405 B1 * 5/2001 Oikawa et al. ..... 347/68
6,234,613 B1 * 5/2001 Feinn et al. ..... 347/65

* cited by examiner

*Primary Examiner* — Juanita D Jackson
(74) *Attorney, Agent, or Firm* — Calfee, Halter & Griswold LLP

(57) ABSTRACT

A printing head and an inkjet printing device are provided. The printing head includes a base, and N printing components on the base, where N≥2. Each of the printing components includes a diversion groove group and a plurality of nozzles. The diversion groove group includes a plurality of diversion grooves, the plurality of diversion grooves and the plurality of nozzles are in one-to-one correspondence, and a first end of each of the diversion grooves is connected to a corresponding nozzle. The center points of all the nozzles are on the same reference line, the opening faces of all the nozzles are in the bottom surface of the base, any two of the diversion groove groups of the N printing components are in different orientations of the reference line, and any two adjacent nozzles respectively belong to two different printing components, which reduces the turbulence between the nozzles.

17 Claims, 5 Drawing Sheets

PRINTING HEAD AND INKJET PRINTING DEVICE

This application claims priority to Chinese Patent Application No. 201810004149.5, filed with the State Intellectual Property Office on Jan. 3, 2018 and titled "Printing head and inkjet printing device", the entire contents of which are incorporated herein by reference.

TECHNICAL FILED

The present disclosure relates to a printing head and an inkjet printing device.

BACKGROUND

The inkjet printing device is a non-contact, template-free, flexible, and low-cost printing device, has the advantages of being environmentally friendly and easy to operate, and therefore has been widely used in recent years. The printing head is the most important part of the inkjet printing device.

SUMMARY

There provides in the present disclosure a printing head and an inkjet printing device.

In an aspect, there is provided a printing head, comprising:

a base;

N printing components disposed on the base, where N≥2;

wherein each of the printing components comprises a diversion groove group and a plurality of nozzles, the diversion groove group comprises a plurality of diversion grooves, the plurality of diversion grooves and the plurality of nozzles are in one-to-one correspondence, and a first end of each of the diversion grooves is connected to a corresponding nozzle; and the center points of all the nozzles are on the same reference line, the opening faces of all the nozzles are in the bottom surface of the base, any two of the diversion groove groups of the N printing components are disposed in different orientations of the reference line, and any two adjacent nozzles respectively belong to two different printing components.

Optionally, the distance between any two adjacent diversion grooves in each of the printing components is equal.

Optionally, the distance between any two adjacent nozzles is equal.

Optionally, the distance a1 between each two adjacent nozzles of all of the nozzles and the distance a2 between each two adjacent diversion grooves in each of the printing components satisfy: a2=N×a1.

Optionally, each of the printing components has an ink storage chamber that is connected to a second end of each of the diversion grooves in the corresponding printing component.

Optionally, in each of the printing components, a partition wall is disposed on one side of a retaining wall between each two adjacent diversion grooves toward the ink storage chamber, and the partition wall has a width smaller than that of the retaining wall.

Optionally, the N printing components comprise at least one first printing component, and for each of the first printing components, a side of the diversion groove facing away from the bottom surface of the base is provided with a notch, and a first piezoelectric film is disposed on the notch.

Optionally, the at least one first printing component comprises at least two first printing components, the at least two first printing components are disposed on at least one side of a reference plane; and the reference plane is substantially perpendicular to a plane in which the openings of all of the nozzles are located, and the reference line is within the reference plane.

Optionally, the at least one first printing component comprises two first printing components, the two first printing components being respectively located on two sides of the reference plane.

Optionally, each of the printing components has an ink storage chamber that is connected to another end of each of the diversion grooves in the corresponding printing component, and the N printing components comprise at least one second printing component, and for each of the second printing components, a second piezoelectric film is disposed on an upper wall of the ink storage chamber.

Optionally, the N printing components comprise one second printing component and two first printing components, the two first printing components being respectively located on two sides of the reference plane, and for the second printing component, a second piezoelectric film is disposed on an upper wall of the ink storage chamber.

Optionally, the second printing component is located above the two first printing components, the ink storage chamber of the second printing component is symmetrical about the reference plane, the extending direction of each diversion groove in the first printing component is substantially parallel to the bottom surface of the base, and the extending direction of each diversion groove in the second printing component is substantially perpendicular to the bottom surface of the base.

Optionally, the extending directions of all of the ink storage chambers are substantially parallel, all of the diversion grooves are arranged along the extending direction, and two ends of each of the ink storage chambers are respectively an ink inlet and an ink outlet of the ink storage chamber; and the base has a total ink inlet and a total ink outlet, the ink inlets of all of the ink storage chambers communicate with the total ink inlet, and the ink outlets of all of the ink storage chambers communicate with the total ink outlet.

Optionally, the base is further provided with a first common diversion groove and a second common diversion groove, the ink inlets of all of the ink storage chambers communicate with the total ink inlet through the first common diversion groove, and the ink outlets of all of the ink storage chambers communicate with the total ink outlet through the second common diversion groove.

In another aspect, there is provided an inkjet printing device, comprising a printing head; wherein the printing head comprises: a base; N printing components disposed on the base, where N≥2; each of the printing components comprises a diversion groove group and a plurality of nozzles, the diversion groove group comprises a plurality of diversion grooves, the plurality of diversion grooves and the plurality of nozzles are in one-to-one correspondence, and a first end of each of the diversion grooves is connected to a corresponding nozzle; and the center points of all the nozzles are on the same reference line, the opening faces of all the nozzles are in the bottom surface of the base, any two of the diversion groove groups of the N printing components are disposed in different orientations of the reference line, and any two adjacent nozzles respectively belong to two different printing components.

Optionally, the distance between any two adjacent diversion grooves in each of the printing components is equal.

Optionally, the distance between any two adjacent nozzles is equal.

Optionally, the distance a1 between each two adjacent nozzles of all of the nozzles and the distance a2 between each two adjacent diversion grooves in each of the printing components satisfy: a2=N×a1.

Optionally, each of the printing components has an ink storage chamber that is connected to a second end of each of the diversion grooves in the corresponding printing component.

Optionally, in each of the printing components, a partition wall is disposed on one side of a retaining wall between each two adjacent diversion grooves toward the ink storage chamber, and the partition wall has a width smaller than that of the retaining wall.

DETAILED DESCRIPTION

The embodiments of the present disclosure will be described in detail with reference to the drawings in order to clearly present the principle and advantages of the present disclosure.

Generally, a printing head comprises: an ink storage chamber, a plurality of diversion grooves and a plurality of nozzles. The plurality of diversion grooves and the plurality of nozzles are in one-to-one correspondence. One end of each of the diversion grooves is connected to the ink storage chamber, and the other end is connected to a corresponding nozzle.

Figure 1:
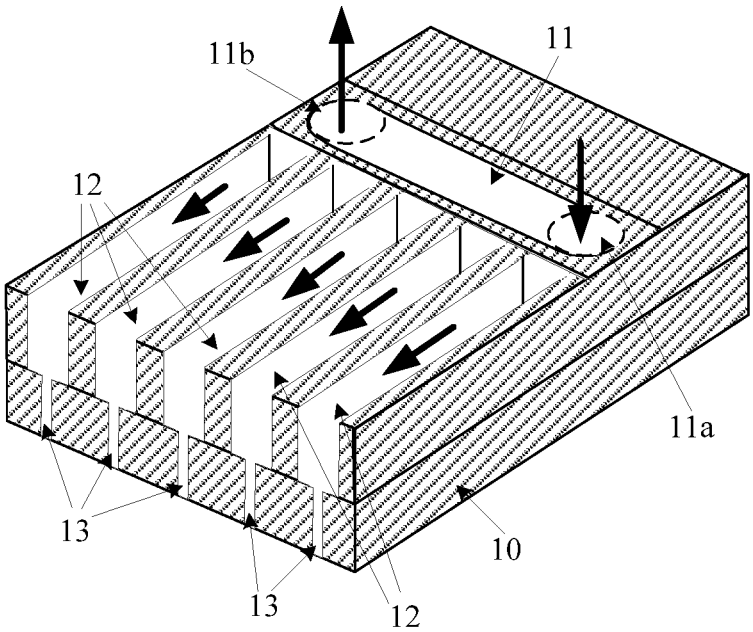
FIG. 1 is a schematic view of a structure of a printing head known by the inventor(s)

Referring to FIG. 1, FIG. 1 is a schematic view of a structure of a printing head known by the inventor(s). The printing head includes a base 10. The base 10 includes an ink storage chamber 11 and a plurality of diversion grooves 12. The ink may enter the ink storage chamber 11 from an ink inlet opening 11*a*, and flow out from an ink outlet opening 11*b*. The plurality of diversion grooves 12 is equally spaced on the base 10. One end of each of the diversion grooves 12 is connected to the ink storage chamber 11 and the other end thereof is connected to a nozzle 13. A protective film and a piezoelectric material (not shown in FIG. 1) cover above the groove faces of all of the diversion grooves 12. By controlling the deformation of the piezoelectric material (since the piezoelectric material has an inverse piezoelectric effect, after a voltage is applied to the piezoelectric material, the piezoelectric material generates a mechanical stress and deforms, which can change the volume of the diversion groove to complete a circulation process of ink absorption, ink ejection, retraction and re-inking), the ink can be absorbed from the ink storage chamber 11 and the absorbed ink can be ejected from the corresponding nozzle to complete the printing.

Figure 2:
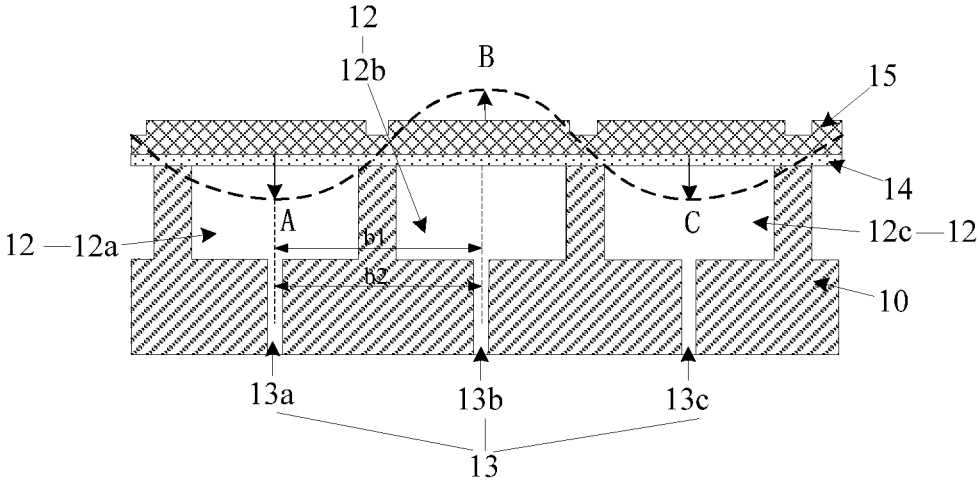
FIG. 2 is a front view of the printing head shown in FIG. 2.

However, when the printing head has a relatively large number of nozzles, the distance between the diversion grooves on the base is relatively close. When a nozzle ejects ink due to the deformation of the piezoelectric material above the diversion groove, the deformed piezoelectric material may affect the shape of the piezoelectric material near the top of the diversion groove and causes turbulence between the nozzles. This turbulence is more serious at a higher nozzle density (i.e., the spacing between adjacent nozzles is small), which causes deviation of the volume of the ink droplets ejected from the nozzles connected near the diversion grooves and affects the printing quality. Exemplarily, as shown in FIG. 2, FIG. 2 is a front view of the printing head shown in FIG. 1. A protective film 14 and a piezoelectric material 15 sequentially cover the base 10. If the piezoelectric material 15 covering the diversion groove 12*b* is controlled to suffer from a deformation B, since the spacing between the respective diversion grooves is small, the piezoelectric material 15 covering the diversion groove 12*a* will be affected and suffer from a deformation A, and the piezoelectric material 15 covering the diversion groove 12*c* will suffer from a deformation C. The deformation A and the deformation C of the piezoelectric material 15 will affect the volume of the ink droplets ejected from the nozzle 13*a* and the nozzle 13*c*.

Conventional printing heads are prone to turbulence between nozzles when there are many nozzles. Two methods for reducing turbulence are currently provided. The first method: the two adjacent partition walls dividing the nearby nozzles are set to different lengths by changing the construction of the ink inlet passage of the nozzle portion. That is, the ending positions of the openings of the diversion grooves near the nozzles, which are connected to the common diversion groove, are different, thereby achieving the effect of reducing the turbulence between adjacent nozzles. The second method: the turbulence effect is improved by optimizing the circuit signal. That is, while the first nozzle is ejecting ink, a corresponding reverse compensation drive signal is applied to the nozzle adjacent thereto to counteract the turbulence of the first nozzle on the adjacent nozzle. The present disclosure, however, proposes another method for reducing the turbulence.

At present, the printing heads may mainly include a piezoelectric printing head and a bubble printing head. The present disclosure is described by taking a piezoelectric printing head as an example. Correspondingly, the structure of the bubble printing head can be easily obtained by the description given in the present disclosure. There may be many types of printing heads in alternative implementations, which are not described in this disclosure.

Figure 3:
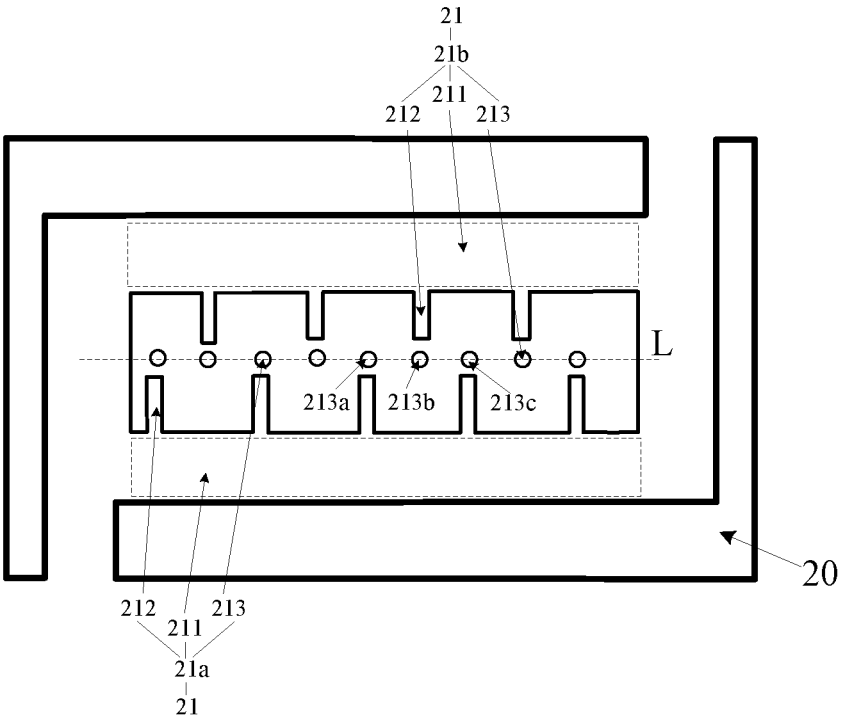
FIG. 3 is a top view of a structure of a printing head according to an embodiment of the present disclosure.

There is provided in embodiments of the present disclosure a printing head, as shown in FIG. 3. FIG. 3 is a top view of a structure of a printing head provided in an embodiment of the present disclosure. The printing head may include a base 20.

N printing components 21 are provided on the base 20, N≥2 (illustrated by N=2 in FIG. 3). The N printing components 21 may include a printing component 21*a* and a printing component 21*b*.

Each printing component 21 may include a diversion groove group (not labeled in FIG. 3) and a plurality of nozzles 213. The diversion groove group includes a plurality of diversion grooves 212. It should be noted that the diversion groove group in each printing component 21 is a set of all the diversion grooves 212 in the corresponding printing component. Only the diversion groove 212 is marked in the drawings in the embodiments of the present disclosure rather than the diversion groove group.

The plurality of diversion grooves 212 and the plurality of nozzles 213 are in one-to-one correspondence. A first end of each of the diversion grooves 212 is connected to the corresponding nozzle 213. In an alternative implementation, each printing component 21 has an ink storage chamber 211 that is connected to a second end of each of the diversion grooves 212 in the corresponding printing component 21. In the embodiment of the present disclosure, the ink storage chambers 211 in different printing components may be connected with each other or may be isolated from each other, which is not limited in the embodiment of the present disclosure.

As shown in FIG. 3, the center points of all the nozzles 213 are all located on the same reference line L. The opening faces of all the nozzles 213 are located in the bottom surface of the base 20. That is, the opening faces of all the nozzles 213 are coplanar. Any two diversion groove groups in the N printing components 21 are disposed in different orientations of the reference line L. Any two adjacent nozzles 213 belong to two different printing components 21, respectively.

It should be noted that the turbulence between the nozzles is caused by the close distance between any two adjacent diversion grooves. As shown in FIG. 3, in the printing head provided in the embodiment of the present disclosure, since any two diversion groove groups of the N printing components 21 are disposed in different orientations of the reference line L (for example, the diversion groove group in the printing component 21*a* is located on the right side of the reference line L, the diversion groove group in the printing component 21*b* is located on the left side of the reference line L), and any two adjacent nozzles 213 belong to the two different printing components 21, respectively (for example, the nozzle 213*a* belongs to the printing component 21*a*, and the nozzle 213*b* belongs to the printing component 21*b*), at least one nozzle being included between two adjacent nozzles 213 of the same printing component belongs to another printing component (for example, the nozzle 213*a* and the nozzle 213*c* in the printing component 21*a* are adjacent, and the nozzle 213*b* included between the nozzle 213*a* and the nozzle 213*c* belongs to the printing head 21*b*). Therefore, the printing head provided in the embodiment of the present disclosure effectively increases the distance between two adjacent diversion grooves 213 in the same printing component 21 on the premise that the nozzle density of the printing head provided in the embodiment of the present disclosure is the same as the nozzle density of the printing head shown in FIG. 1.

In summary, in the printing head provided in the embodiment of the present disclosure, since any two diversion groove groups in N printing components are disposed in different orientations of a reference line, and any two adjacent nozzles respectively belong to two different printing components, the two diversion grooves corresponding to any two adjacent nozzles respectively belong to two diversion groove groups in different orientations, and thus in the printing heads, there is also provided a nozzle belonging to another printing component between two nozzles corresponding to any two adjacent diversion grooves in the same printing component. Therefore, on the premise that the nozzle density of the printing head provided in the embodiment of the present disclosure is the same as the nozzle density of the printing head shown in FIG. 1, the distance between two adjacent diversion grooves belonging to the same printing component in the printing head provided in the embodiment of the present disclosure is large, which reduces the turbulence between the nozzles, and effectively improves the printing quality of the inkjet printing head.

In an alternative implementation, the N printing components may include: at least one first printing component, or at least one second printing component, or at least one first printing component and at least one second printing component. The ink-jetting process of the first printing component is controlled by a piezoelectric film disposed on groove faces of the diversion grooves. The ink-jetting process of the second printing component is controlled by a piezoelectric film disposed on the ink storage chamber. The piezoelectric films of the first printing component and the second printing component are disposed differently, and thus the structure of the first printing component is different from the structure of the second printing component. The following embodiments first introduce the structures of the first printing component and the second printing component, and then describe to which type of printing components the N printing components provided on the base specifically belong to. Exemplarily, the material of the piezoelectric film in the embodiments of the present disclosure is a piezoelectric material.

Figure 4:
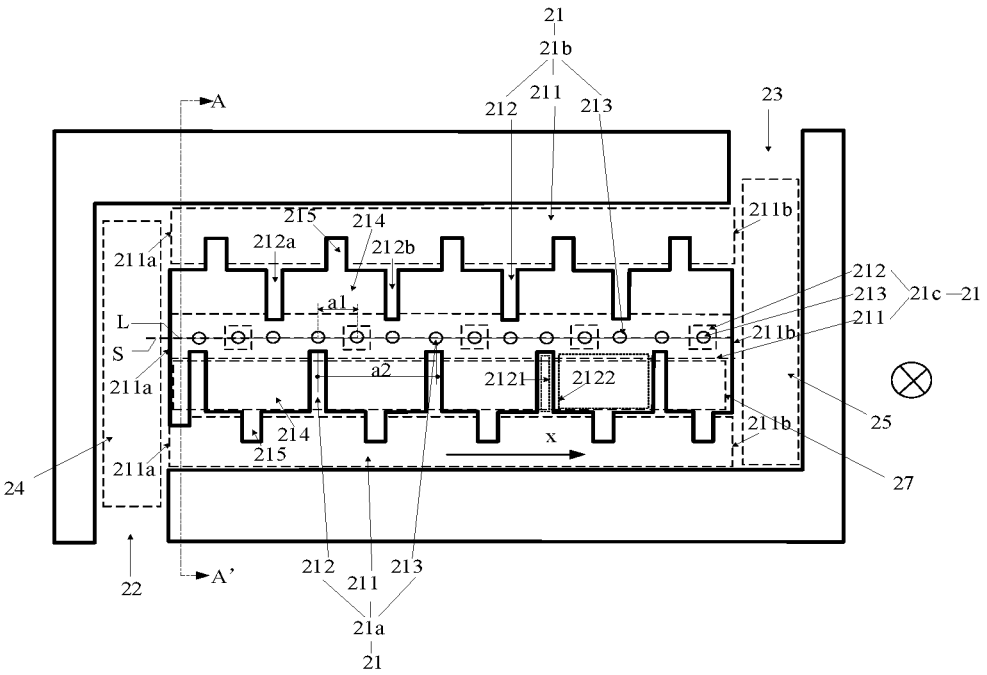
FIG. 4 is a top view of a structure of another printing head according to an embodiment of the present disclosure.
Figure 5:
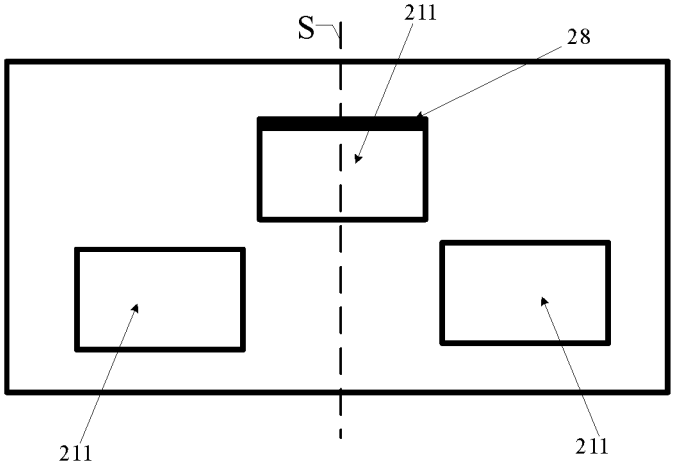
FIG. 5 is a cross-sectional view of the printing head shown in FIG. 4 at A-A'.

FIG. 4 is a top view of a structure of another printing head provided in an embodiment of the present disclosure. FIG. 5 is a cross-sectional view of the printing head shown in FIG. 4 at A-A'. Referring to FIGS. 4 and 5, the printing head is described by taking three printing components 21 being disposed on the base 20 as an example, that is, N=3. The printing component 21*a* and the printing component 21*b* are the first printing components, and the printing component 21*c* is the second printing component. Exemplarily, the ink storage chamber 211 located on the left side in FIG. 5 belongs to the printing component 21*b* in FIG. 4. The ink storage chamber 211 located on the right side in FIG. 5 belongs to the printing component 21*a* in FIG. 4. The ink storage chamber 211 located in the upper part in FIG. 5 belongs to the printing component 21*c* in FIG. 4. For the printing head of FIG. 4, the diversion groove group in the printing component 21*a* is located on the right side of the reference line L, the diversion groove group in the printing component 21*b* is located on the left side of the reference line L, and the diversion groove group in the printing component 21*c* is on the upper side of the reference line L.

For each first print component:

For example, as shown in FIG. 4 or FIG. 5, in the printing component 21*a* or the printing component 21*b*, the first end and the second end of each of the diversion grooves 212 have an opening respectively. A notch 2121 is opened on one side of the bottom surface of the diversion groove 212 facing away from the base 20. At this time, the diversion groove 212 has three opening faces. The notch 2121 is provided with a first piezoelectric film 27. That is, the first piezoelectric film 27 may be covered above the groove face 2122 of the diversion groove 212. In an alternative implementation, in order to avoid damage to the first piezoelectric film 27 by the ink, a first protective film and the first piezoelectric film 27 may be sequentially stacked on the notch 2121. The first piezoelectric film 27 may be protected by the first protective film. Generally, the extending direction of each of the diversion grooves 212 in the first printing component is substantially parallel to the bottom surface of the base 20.

For each second printing component:

For example, as shown in FIG. 4 or FIG. 5, in the printing component 21*c*, the first end and the second end of each of the diversion grooves 212 have an opening respectively. At this time, the diversion groove 212 has two opening faces. A second piezoelectric film 28 is disposed on the upper wall of the ink storage chamber 212. In an alternative implementation, in order to avoid damage to the second piezoelectric film 28 by the ink, the second piezoelectric film 28 and a second protective film may be sequentially disposed on the upper wall of the ink storage chamber 212 in a direction away from the upper wall. The second piezoelectric film 28 may be protected by the second protective film. Generally, the extending direction of each of the diversion grooves 212 in the second printing component is substantially perpendicular to the bottom surface of the base 20. At this time, the second end of each of the diversion grooves 212 is located right above the first end of the diversion groove 212.

It should be noted that the term "substantially parallel" mentioned in above embodiment refers to the angle range between the two is [0, 20] degree, and the term "substantially perpendicular" mentioned in above embodiment refers to the angle range between the two is [70, 90] degree.

Furthermore, since the N printing components may include: at least one first printing component, or at least one second printing component, or at least one first printing component and at least one second printing component, there may be a plurality of implementations for the printing components provided on the base. The embodiments of the present disclosure take the following three implementable ways as examples for illustrative description.

In a first implementable way, only the first printing component may be disposed on the base in the printing head provided in the embodiments of the present disclosure. At this time, the N printing components may include: at least two first printing components.

Figure 6:
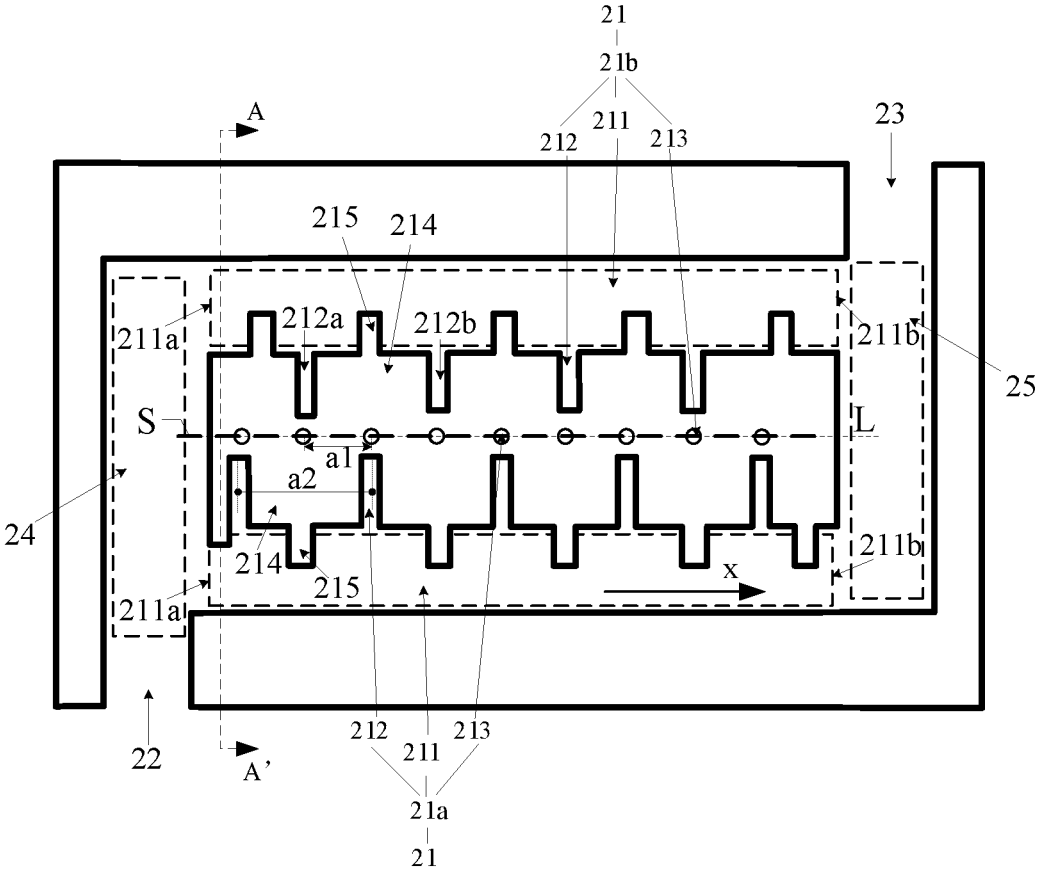
FIG. 6 is a top view of a structure of still another printing head according to an embodiment of the present disclosure.
Figure 7:
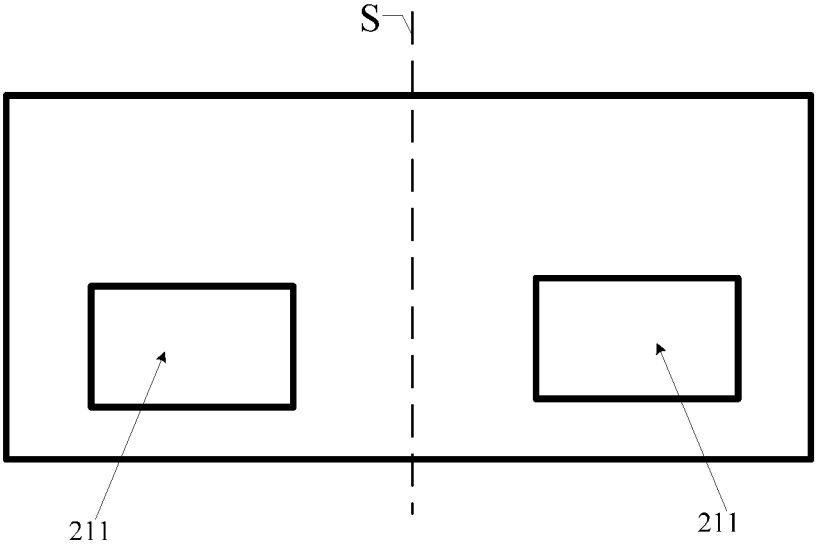
FIG. 7 is a cross-sectional view of the printing head shown in FIG. 6 at A-A'.

FIG. 6 is a top view of a structure of still another printing head provided in an embodiment of the present disclosure. FIG. 7 is a cross-sectional view of the printing head shown in FIG. 6 at A-A'. Referring to FIGS. 6 and 7, the at least two first printing components are disposed on at least one side of a reference plane S. The reference plane S is substantially perpendicular to the opening faces of all the nozzles 213. The opening face is the bottom surface of the base 21. And, the reference line L formed by the center points of all the nozzles 213 is within the reference plane S. For the structure of each of the first printing components, reference may be made to the corresponding parts in the above embodiments, and details are not described herein again. It is to be noted that the ink storage chamber 211 located on the left side in FIG. 7 belongs to the printing component 21*b* in FIG. 6, and the ink storage chamber 211 located on the right side in FIG. 7 belongs to the printing component 21*a* in FIG. 6. For the printing head in FIG. 6, the diversion groove group in the printing component 21*a* is on the right side of the reference line L, and the diversion groove group in the printing component 21*b* is on the left side of the reference line L.

In a second implementable way, only the second printing component may be disposed on the base in the printing head provided in the embodiment of the present disclosure. At this time, the N printing components may include: at least two second printing components. For the structure of each of the second printing components, reference may be made to the corresponding parts in the above embodiments, and details are not described herein again.

In a third implementable way, the base in the printing head provided in the embodiment of the present disclosure may be provided with the first printing component, as well as the second printing component. At this time, the N printing components may include: at least one first printing component and at least one second printing component. For the structure of each of the first printing components and the structure of each of the second printing components, reference may be made to the corresponding portions in the above embodiments, and details are not described herein again.

By combining two of the above implementable ways, the following embodiments exemplify the specific structure of two types of printing heads.

In the first structure, when N=2, as shown in FIG. 6 and FIG. 7, two printing components 21 may be disposed on the base 20 in the printing head. The two printing components 21 may both be the first printing components. Optionally, the two printing components 21 are respectively located on two sides of the reference plane S.

In the second structure, when N=3, as shown in FIG. 4 and FIG. 5, three printing components 21 may be disposed on the base 20 in the printing head. The three printing components 21 may include: two first printing components (for example, the printing component 21*a* and the printing component 21*b*), and one second printing component (for example, the printing component 21*c*). Optionally, the two first printing components are respectively located on two sides of the reference plane S. That is, the printing component 21*a* and the printing component 21*b* are respectively located on two sides of the reference plane S. The second printing component is located above the two first printing components. That is, the printing component 21*c* is located above the printing component 21*a*, and the printing component 21*c* is also located above the printing component 21*b*. Optionally, the ink storage chamber 211 of the printing component 21*c* (i.e., the second printing component) is symmetrical about the reference plane S.

In the embodiments of the present disclosure, as shown in FIG. 4 and FIG. 6, the distance a2 between any two adjacent diversion grooves 212 in each printing component 21 is equal. That is, the diversion grooves 212 in each of the printing components 21 are equally arranged. The distance a1 between any two adjacent nozzles 213 is equal. That is, all the nozzles 213 in the printing head are equally spaced. At this time, the distance a1 between each two adjacent nozzles of all the nozzles 213 and the distance a2 between each two adjacent diversion grooves in each printing component 21 satisfy: a2=N×a1. It should be noted that the distance between any two adjacent nozzles in the embodiment of the present disclosure refers to the distance between the center points (i.e., the geometric center point) of any two nozzles. The distance between each two adjacent diversion grooves refers to the distance between the preset symmetry planes in each two adjacent diversion grooves. The predetermined symmetry plane is substantially perpendicular to the reference line.

Exemplarily, when N=2, as shown in FIG. 6, a2=2×a1; when N=3, as shown in FIG. 4, a2=3×a1.

As shown in FIG. 2, the distance b2 between each two adjacent nozzles 12 and the distance b1 between each two adjacent diversion grooves satisfy: b2=b1. Moreover, as the density of the nozzle increases, the distance between each two adjacent diversion grooves is gradually reduced. Since the piezoelectric material is adhered to the groove face of the diversion groove by glue, when the distance between each two adjacent diversion grooves is gradually reduced, the bonding area of the piezoelectric material is small, thereby affecting the service life and reliability of the printing head.

In the embodiments of the present disclosure, in the same printing component, the distance between two adjacent diversion grooves may be increased to N times of the distance between two adjacent diversion grooves in FIG. 2. At this time, for the first printing component, when the first piezoelectric film is disposed on the first printing component, since the first piezoelectric film is adhered to the groove face of the diversion groove by glue, and the distance between two adjacent diversion grooves is large, the bonding area of the first piezoelectric film is effectively increased, thereby effectively improving the service life and reliability of the printing head.

Optionally, as shown in FIG. 4 and FIG. 6, in each printing component 21, a partition wall 215 is disposed on one side, toward the ink storage chamber 211, of a retaining wall 214 between each two adjacent diversion grooves 212. The partition wall 215 has a width smaller than that of the retaining wall 214. In an alternative implementation, when the printing head is in operation, the ink in the diversion groove 212 is reflowed under the action of the piezoelectric film (the piezoelectric film may be the first piezoelectric film 27 in the first printing component, or may be the second piezoelectric film 28 in the second printing component). That is, the ink in the diversion groove 212 is moved toward the ink storage chamber 211. During the reflow process, turbulence may occur between two adjacent diversion grooves 212. For example, when the ink in the diversion groove 212*a* moves to the ink storage chamber 211, the ink in the diversion groove 212*a* may generate a water wave effect. The water wave generated by the diversion groove 212*a* may move toward the diversion groove 212*b*. Similarly, the ink in the diversion groove 212*b* may also generate a water wave effect. The water wave generated by the diversion groove 212*b* will move toward the diversion groove 212*a*, resulting in the turbulence between the diversion groove 212*a* and the diversion groove 212*b* under the effect of water wave, thus affecting the printing quality. When a partition wall 215 is disposed between two adjacent diversion grooves 212, the partition wall 215 can effectively weaken the water wave effect of the ink in the diversion groove 212*b*, thereby effectively reducing the turbulence between two adjacent diversion grooves 212.

Optionally, as shown in FIG. 4 and FIG. 6, the extending directions x of all of the ink storage chambers 211 disposed on the base 20 are substantially parallel. The two ends of each of the ink storage chambers 211 are respectively an ink inlet 211*a* and an ink outlet 211*b* of the ink storage chamber. All the diversion grooves 212 are arranged in the extending direction x. The extending directions of the diversion grooves 212 in each printing component 21 are substantially parallel.

Optionally, as shown in FIG. 4 and FIG. 6, the base 20 has a total ink inlet 22 and a total ink outlet 23. The ink inlets 211*a* of all of the ink storage chambers 211 are connected to the total ink inlet 22. The ink outlets 211*b* of all of the ink storage chambers 211 are connected with the total ink outlets 23. In the embodiments of the present disclosure, the base 20 is further provided with a first common diversion groove 24 and a second common diversion groove 25. The ink inlets 211*a* of all of the ink storage chambers 211 are connected to the total ink inlet 22 through the first common diversion groove 24. The ink outlets 211*b* of all of the ink storage chambers 211 are connected to the total ink outlet 23 through the second common diversion groove 25.

Figure 8:
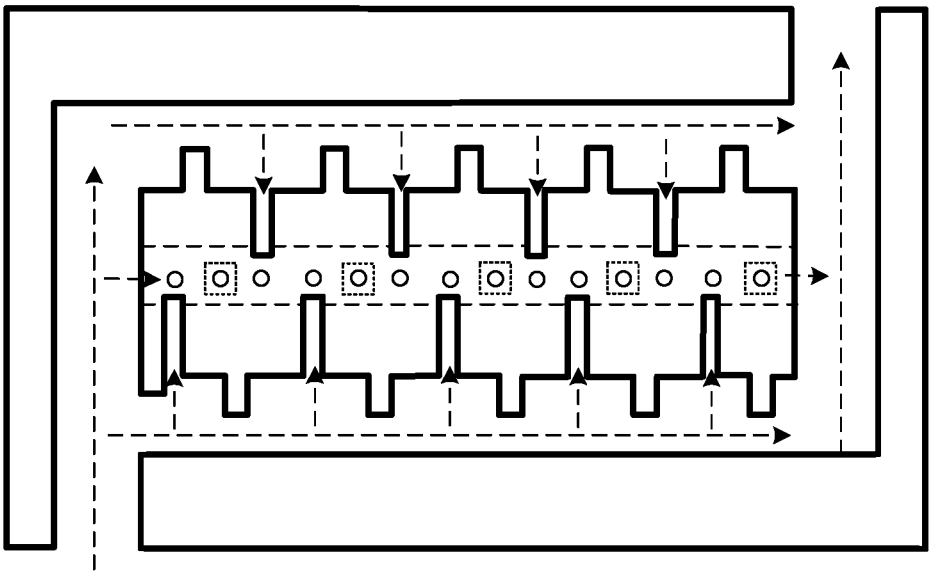
FIG. 8 is an ink flow effect diagram of the printing head shown in FIG. 4.
Figure 9:
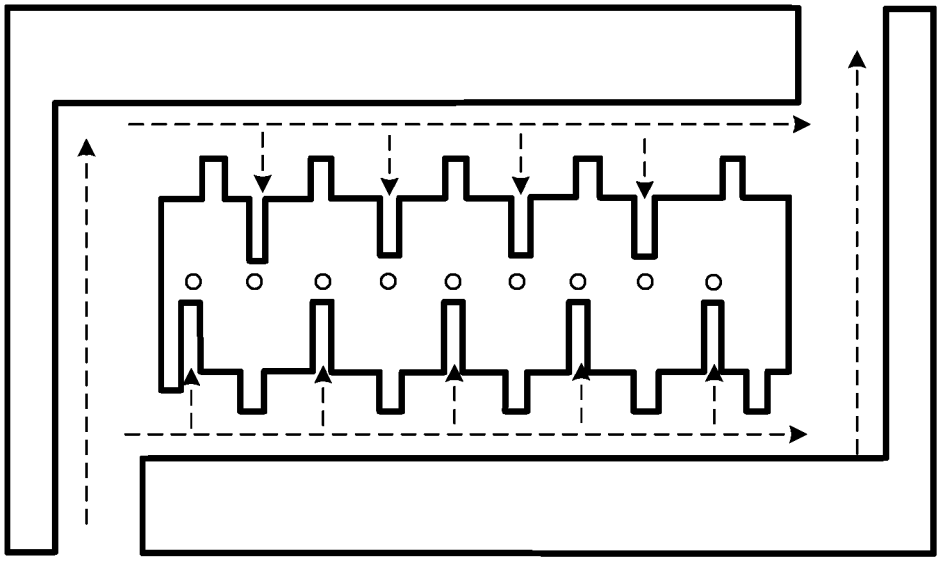
FIG. 9 is an ink flow effect diagram of the printing head shown in FIG. 6.

In the embodiments of the present disclosure, referring to FIG. 8 and FIG. 9. FIG. 8 is an ink flow effect diagram of the printing head shown in FIG. 4. FIG. 9 is an ink flow effect diagram of the printing head shown in FIG. 6. The flow direction of the ink can be indicated by arrows. Thus the flow direction of the ink in the inkjet process of the printing head can be more clearly described.

In summary, in the printing head provided in the embodiment of the present disclosure, since the diversion groove groups in N printing components are disposed in different orientations of a reference line, and any two adjacent nozzles respectively belong to two different printing components, the two diversion grooves corresponding to any two adjacent nozzles respectively belong to two diversion groove groups in different orientations, and thus in the printing heads, there are also provided nozzles belonging to other printing components between two nozzles corresponding to any two adjacent diversion grooves in the same printing component. Therefore, on the premise that the nozzle density of the printing head provided in the embodiment of the present disclosure is the same as the nozzle density of the printing head shown in FIG. 1, the distance between two adjacent diversion grooves belonging to the same printing component in the printing head provided in the embodiment of the present disclosure is large, which reduces the turbulence between the nozzles, and effectively improves the printing quality of the inkjet printing head. Moreover, since the distance between two adjacent diversion grooves in the same printing component is large in the printing head, when the piezoelectric film is adhered to the groove face of the diversion groove by glue, the bonding area of the piezoelectric film is large, thereby effectively improving the service life and reliability of the printing head.

There is also provided in the present disclosure an inkjet printing device, which may include the printing head shown in FIG. 2, FIG. 4 or FIG. 6. In an alternative implementation, the inkjet printing device may further include: a carrier base for carrying a base substrate. The printing head may perform inkjet printing on the base substrate located on the carrier base.

The foregoing descriptions are only exemplary embodiments of the present disclosure, and are not intended to limit the present disclosure. Within the spirit and principles of the disclosure, any modifications, equivalent substitutions, improvements, etc., are within the scope of protection of the present disclosure.

What is claimed is:

1. A printing head, comprising:

a base;

N printing components on the base, where N≥2;

wherein each of the printing components comprises a diversion groove group and a plurality of nozzles, the diversion groove group comprises a plurality of diversion grooves, the plurality of diversion grooves and the plurality of nozzles are in one-to-one correspondence, and a first end of each of the diversion grooves is connected to a corresponding nozzle, center points of all the nozzles are on a same reference line, opening faces of all the nozzles are in a bottom surface of the base, any two of the diversion groove groups of the N printing components are in different orientations of the reference line, and any two adjacent nozzles respectively belong to two different printing components, each of the printing components has an ink storage chamber that is connected to a second end of each of the diversion grooves in the corresponding printing component, an extending direction of all of the ink storage chambers are substantially parallel, all of the diversion grooves are along the extending direction, and two ends of each of the ink storage chambers are respectively an ink inlet and an ink outlet of the ink storage chamber, and the base has a total ink inlet and a total ink outlet, the ink inlets of all of the ink storage chambers are connected to the total ink inlet, and the ink outlets of all of the ink storage chambers are connected to the total ink outlet.

2. The printing head according to claim 1, wherein a distance between any two adjacent diversion grooves in each of the printing components is equal.

3. The printing head according to claim 2, wherein a distance between any two adjacent nozzles is equal.

4. The printing head according to claim 3, wherein the distance a1 between any two adjacent nozzles of all of the nozzles and the distance a2 between any two adjacent diversion grooves in each of the printing components satisfy:

$$a2=N\times a1.$$

5. The printing head according to claim 1, wherein in each of the printing components, a partition wall is on one side of a retaining wall between each two adjacent diversion grooves toward the ink storage chamber, and the partition wall has a width smaller than that of the retaining wall.

6. The printing head according to claim 1, wherein the N printing components comprise at least one first printing component, and for each of the first printing components, a notch is on a side of the diversion groove facing away from the bottom surface of the base, and a first piezoelectric film is on the notch.

7. The printing head according to claim 6, wherein the at least one first printing component comprises at least two first printing components, the at least two first printing components are on at least one side of a reference plane; and the reference plane is substantially perpendicular to a plane in which the openings of all of the nozzles exist, and the reference line is within the reference plane.

8. The printing head according to claim 7, wherein the at least one first printing component comprises two first printing components which are on two sides of the reference plane respectively.

9. The printing head according to claim 7, wherein the N printing components comprise one second printing component and two first printing components, the two first printing components being respectively on two sides of the reference plane, and for the second printing component, a second piezoelectric film is on an upper wall of the ink storage chamber.

10. The printing head according to claim 9, wherein the second printing component is above the two first printing components, the ink storage chamber of the second printing component is symmetrical about the reference plane, an extending direction of each diversion groove in the first printing component is substantially parallel to the bottom surface of the base, and an extending direction of each diversion groove in the second printing component is substantially perpendicular to the bottom surface of the base.

11. The printing head according to claim 1, wherein the N printing components comprise at least one second printing component, and for each of the second printing components, a second piezoelectric film is on an upper wall of the ink storage chamber.

12. The printing head according to claim 1, wherein a first common diversion groove and a second common diversion groove is on the base, the ink inlets of all of the ink storage chambers are connected to the total ink inlet through the first common diversion groove, and the ink outlets of all of the ink storage chambers are connected to the total ink outlet through the second common diversion groove.

13. An inkjet printing device, comprising a printing head; wherein the printing head comprises:

a base;

N printing components on the base, where N≥2;

each of the printing components comprises a diversion groove group and a plurality of nozzles, the diversion groove group comprises a plurality of diversion grooves, the plurality of diversion grooves and the plurality of nozzles are in one-to-one correspondence, and a first end of each of the diversion grooves is connected to a corresponding nozzle, center points of all the nozzles are on a same reference line, the opening faces of all the nozzles are in a bottom surface of the base, any two of the diversion groove groups of the N printing components are in different orientations of the reference line, and any two adjacent nozzles respectively belong to two different printing components, each of the printing components has an ink storage chamber that is connected to a second end of each of the diversion grooves in the corresponding printing component, an extending direction of all of the ink storage chambers are substantially parallel, all of the diversion grooves are along the extending direction, and two ends of each of the ink storage chambers are respectively an ink inlet and an ink outlet of the ink storage chamber, and the base has a total ink inlet and a total ink outlet, the ink inlets of all of the ink storage chambers are connected to the total ink inlet, and the ink outlets of all of the ink storage chambers are connected to the total ink outlet.

14. The inkjet printing device according to claim 13, wherein a distance between any two adjacent diversion grooves in each of the printing components is equal.

15. The inkjet printing device according to claim 14, wherein a distance between any two adjacent nozzles is equal.

16. The inkjet printing device according to claim 15, wherein the distance a1 between any two adjacent nozzles of all of the nozzles and the distance a2 between any two adjacent diversion grooves in each of the printing components satisfy:

$$a2=N\times a1.$$

17. The inkjet printing device according to claim 13, wherein in each of the printing components, a partition wall is on one side of a retaining wall between each two adjacent diversion grooves toward the ink storage chamber, and the partition wall has a width smaller than that of the retaining wall.

* * * * *